United States Patent [19]

Newsom et al.

[11] Patent Number: 4,680,584

[45] Date of Patent: Jul. 14, 1987

[54] ACOUSTIC PRELAUNCH WEAPON COMMUNICATION SYSTEM

[75] Inventors: Steven S. Newsom, Middletown, R.I.; James M. McCarthy, Mattapoisett, Mass.

[73] Assignee: The United States of America as represented by the Secretary of the Navy, Washington, D.C.

[21] Appl. No.: 730,024

[22] Filed: May 3, 1985

[51] Int. Cl.[4] ..... F42B 19/10; G08C 19/10; H04B 11/00

[52] U.S. Cl. ..... 340/850; 367/134; 367/141; 340/825.72; 370/112; 114/21.1; 114/21.2

[58] Field of Search ..... 114/20 R, 21 R, 21 W, 114/21 A, 238; 340/365 S, 825.57, 850, 851, 825.72; 370/112, 119; 367/2, 3, 77, 78, 79, 80, 134, 140, 141, 197, 131, 133, 135, 137

[56] References Cited

U.S. PATENT DOCUMENTS

| | | | |
|---|---|---|---|
| 3,243,592 | 3/1966 | Tomiyasu et al. | 340/850 |
| 3,626,882 | 12/1971 | Russo et al. | 114/21 R |
| 3,737,857 | 6/1973 | Carman | 367/197 |
| 3,753,221 | 8/1973 | Stevens | 367/197 |
| 3,783,441 | 1/1974 | Slawsky | 114/21 W X |
| 3,864,662 | 2/1975 | David et al. | 340/851 X |
| 4,064,806 | 12/1977 | Apstein et al. | 367/133 X |
| 4,065,747 | 12/1977 | Patten et al. | 367/197 X |
| 4,147,222 | 4/1979 | Patten et al. | 367/133 X |
| 4,274,353 | 6/1981 | Foss et al. | 114/21 A |
| 4,533,945 | 8/1985 | Lauvray et al. | 340/850 X |

*Primary Examiner*—Deborah L. Kyle
*Assistant Examiner*—Brian S. Steinberger
*Attorney, Agent, or Firm*—Arthur A. McGill; Prithvi C. Lall; Michael J. McGowan

[57] ABSTRACT

The transmission of prelaunch weapon communication in a submarine is accomplished without the use of an umbilical cord. Acoustic transducers transmit and receive acoustic data through water in place of the umbilical cord. The data transmitted through the water from the launch tube wall to the weapon is in serial format having been converted from parallel data by multiplexing.

2 Claims, 3 Drawing Figures

ACOUSTIC PRELAUNCH WEAPON COMMUNICATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to data transmission. More particularly the invention comprises a system that transmits simultaneously a plurality of data signals through air and water where the sending and receiving ends will be separated from further communication at the end of the data transmission. In other words prelaunch information is sent to a launch vehicle wherein one of the mediums to be penetrated is water.

2. Description of the Prior Art

A previous method of transmitting the prelaunch weapon communications comprises using a large umbilical cable. This cable carried information from the tube door to the weapon. When the weapon is launched, the cable would disengage by breaking two shear screws and remain in the tube, while the weapon proceeded on its mission. Unfortunately, due to the fragile nature of the shear screws, problems molding the cable ends and user error, the failure rate of these cables is often above 10%. In addition, these cables are only good for one use without being returned to a refit facility. Even then, they often could not be used a second time due to corrosion.

SUMMARY OF THE INVENTION

The present invention comprises a data communication system for transmitting data from a fire control system to a weapon electronic system such as that on a torpedo where one of the mediums through which the data passes is water and following the transmission of data the weapon holding the weapon electronic system is fired. The data communication system has a multiplexer for receiving parallel data and transmitting the data in multiplexed serial form. A first acoustic transducer receives the serial electronic data and converts it to acoustic form which is transmitted across a gap of water. A second acoustic transducer receives the acoustic data and returns it to serial electronic data. A demultiplexer receives the serial electronic data and converts it to parallel data for receipt by the weapon electronic system.

DESCRIPTION OF THE PREFERRED EMBODIMENTS

Figure 1:
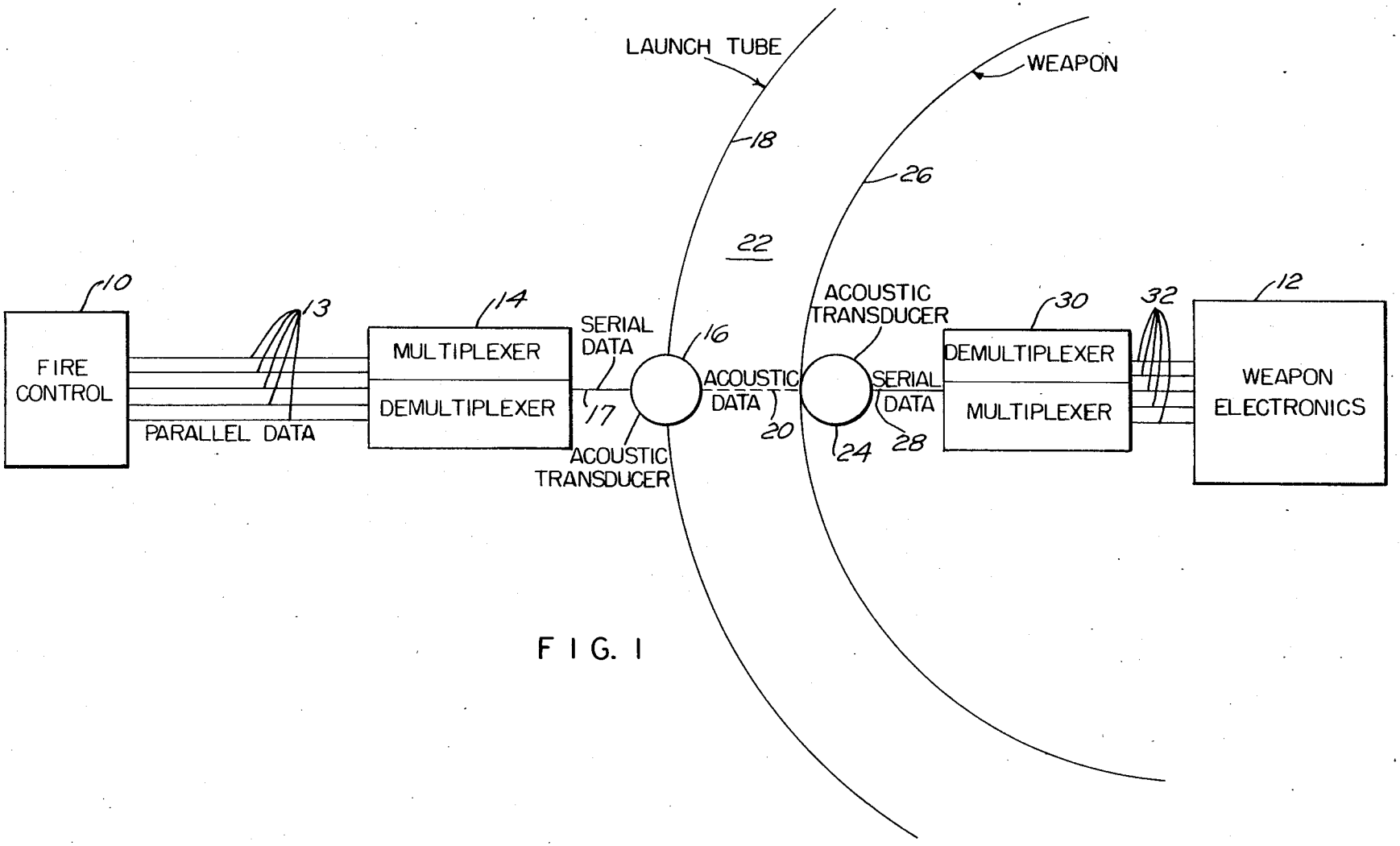
FIG. 1 is a prelaunch weapon communication system in accordance with the present invention.

Referring now to FIG. 1 there is shown a fire control system 10 for transmitting information to a weapon electronic system 12. In order to allow the weapon electronic system to send information back to the fire control system the process about to be described with reference to FIG. 1 is reversed.

The fire control system 10 sends parallel data over lines 13 to a multiplexer 14. The multiplexer 14 converts the received parallel data to serial multiplexed form and transmits this serial data to an acoustic transducer 16 over line 17. The acoustic transducer 16 is mounted to the wall or door of the launch tube 18 and is made watertight by the use of watertight connectors, seal or other well known devices. The acoustic transducer 16 converts the received electrical signal to an acoustic signal and transmits this as acoustic data 20 through a water medium 22 of approximately three inches to another acoustic transducer 24 that is mounted to the shell of a weapon 26. The acoustic data 20 is reconverted to multiplexed electronic serial data and transmitted over line 28 to demultiplexer 30. The de-multiplexer 30 reconverts the serial data to parallel data and transmits it to the weapons electronic system 12 over lines 32.

Figure 2:
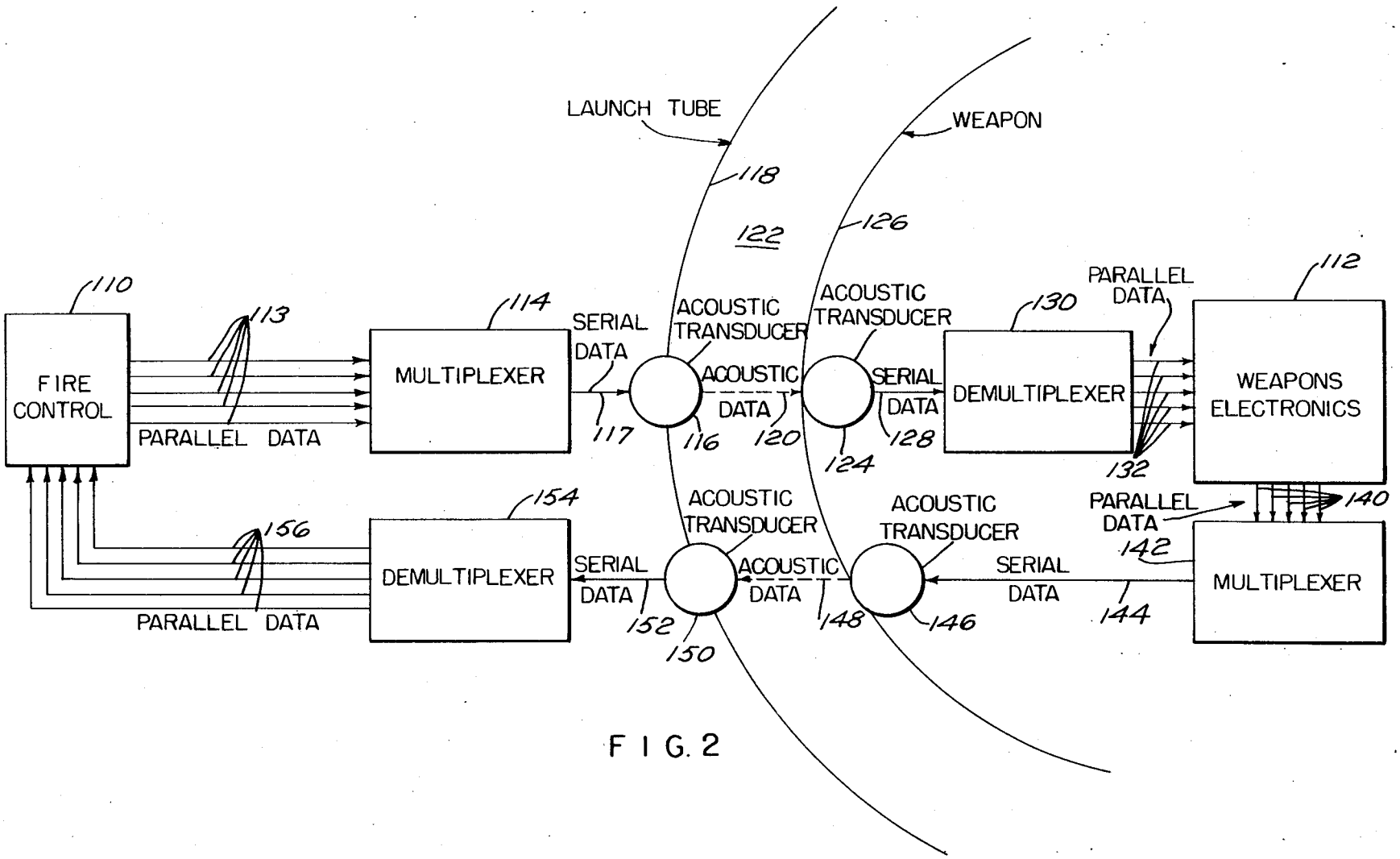
FIG. 2 is a modified version of the system of FIG. 1 showing separate transmitting and receiving transducers.

Referring now to FIG. 2 there is shown a prelaunch communication system having one set of components for transmitting information from a fire control system 110 to a weapons electronics system 112 and a separate set of components for transmitting information from the weapons electronics system 112 to the fire control system 110. The information from fire control system 110 to weapon electronics 112 is transmitted similar to that recited for FIG. 1. Parallel data is forwarded to multiplexer 114 over lines 113. Serial data is forwarded to acoustic transducer 116 over line 117. Acoustic data is forwarded to acoustic transducer 124 through the water medium 122. Serial data is then forwarded to de-multiplexer 130 over line 128 and parallel data is transmitted to weapon electronics 112 over lines 132.

Information from the weapon electronics system 112 to fire control system 110 is transmitted in a similar fashion utilizing parallel line 140, multiplexer 142, line 144, acoustic transducer 146, water medium 122 for acoustic data 148, acoustic transducer 150, line 152, demultiplexer 154, parallel lines 156 and fire control system 110.

The acoustic transducers 116 and 124 carrying acoustic data 120 should be separated an adequate distance from acoustic transducers 146 and 150 carrying acoustic data 148 so that interference from cross talk does not occur. This distance can be easily determined by cut-and-try methods for each type facility.

Figure 3:
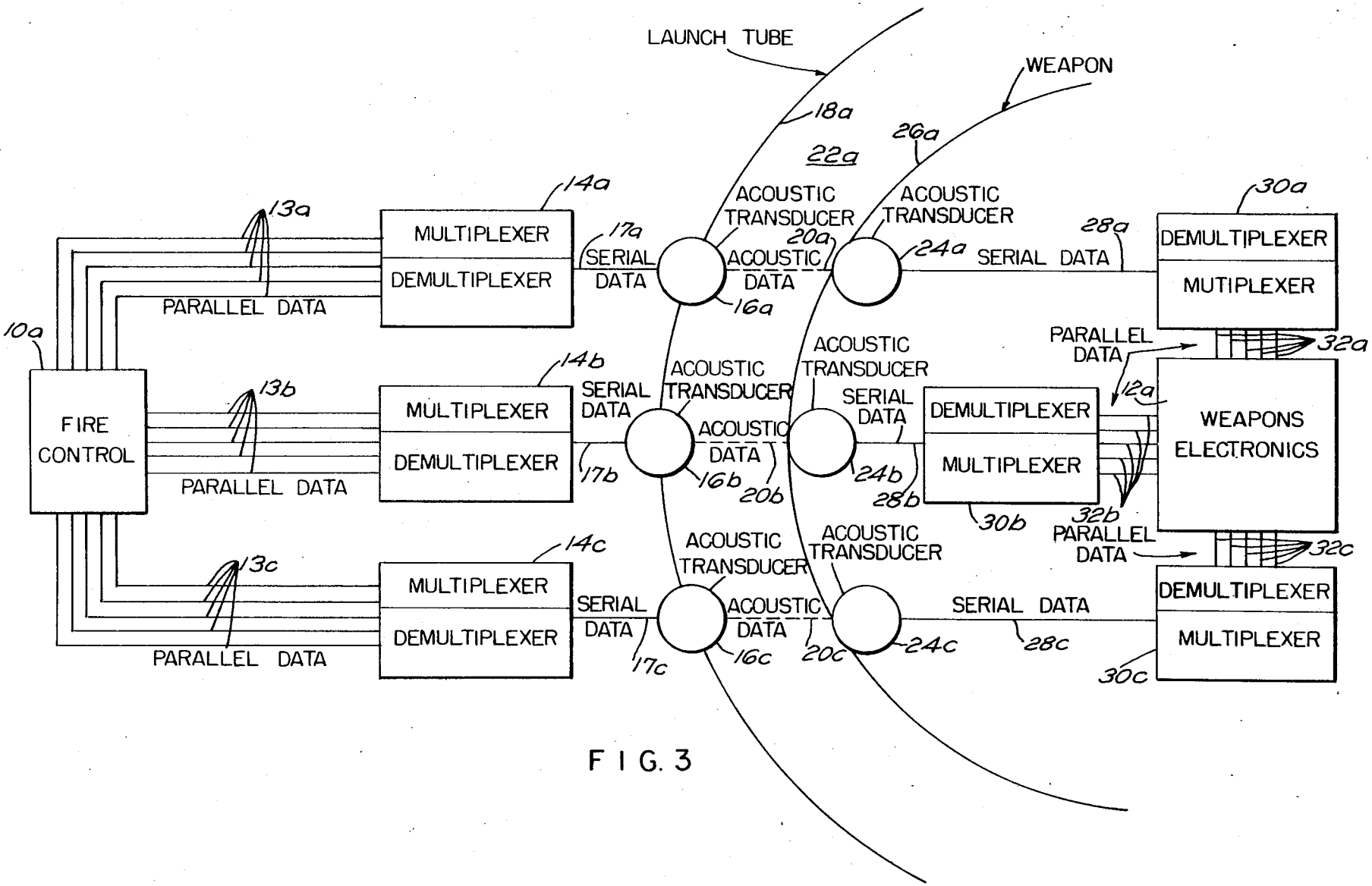
FIG. 3 is a modified version of the system of FIG. 1 showing multiple transducers.

For systems having a large amount of simultaneous data to be transmitted the arrangement shown in FIG. 3 could be used. The operation of each path is similar to that described for FIG. 1.

The fire control system **10*a* has three separate paths available for transmitting information to weapon electronics system 12*a*. Information can also be sent from weapon electronics system 12*a* to fire control system 10*a*. The components used in FIG. 3 are similar to those of FIG. 1 and use the same numerical notation with a letter added for distinguishing them. The launch tube wall 18*a* and weapon shell 26*a* would be modified for the additional transducers. Each transducer pair 16*a* and 24*a*, 16*b* and 24*b*, and 16*c* and 24*c*** should be adequately spaced from each other transducer to prevent cross talk.

There has therefore been described a transmission system for sending prelaunch weapon information in which the use of an umbilical cable. This has the advantage that with the loading of a new weapon the system is immediately ready for reuse with no worry of damage to the umbilical cord. The use of an acoustic data link for transmission is a new feature in devices of this nature.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An acoustic prelaunch weapon communication system for providing information between a fire control system and a launchable underwater weapon electronic system comprising:

first multiplexing means adapted to receive parallel data electrical signals from said fire control system for converting said parallel data electrical signals to serial data multiplexed electrical signals, said first multiplexing means further comprises first parallel electrical lines connected to said fire control system and a first multiplexer/demultiplexer unit connected to said first parallel electrical lines;

a launch tube;

first acoustic transducer means mounted on a wall of said launch tube and connected to receive said serial data multiplexed electrical signals for converting said serial data electrical signals to acoustic data signals and transmitting said acoustic data signals, said first acoustic transducer means further comprises a first serial electrical line connected to said first multiplexer/demultiplexer unit and a first acoustic transducer connected to said first serial electrical line;

a launchable underwater weapon;

a cavity adapted to contain seawater located between and separating said launch tube and said launchable underwater weapon;

second acoustic transducer means mounted to the shell of said launchable underwater weapon and connected to receive said acoustic data signals from said first acoustic transducer means for converting said acoustic data signals to serial data multiplexed electrical signals, said second acoustic transducer means further comprises a second acoustic transducer and a second serial electrical line connected to said second acoustic transducer;

second multiplexing means located within the shell of said launchable underwater weapon and connected to receive said serial data multiplexed electrical signals and for demultiplexing said serial data multiplexed electrical signals and converting them to parallel data signals and adapted to provide said parallel data signals to said launchable underwater weapon electronic system, said second multiplexing means further comprises a second multiplexer/demultiplexer unit connected to said second serial electrical line and second parallel electrical lines connected between said second multiplexer/demultiplexer unit and said launchable underwater weapon electronic system, said second multiplexing means further adapted to receive parallel data electrical signals from said launchable underwater electrical signals from said launchable underwater weapon electronic system for converting said parallel data electrical signals to serial data multiplexed electrical signals;

said second acoustic transducer means connected to receive said serial data multiplexed electrical signals from said second multiplexing means for converting said serial data electrical signals to acoustic data signals and transmitting said acoustic data signals;

said first acoustic transducer means connected to receive said acoustic data signals from said second acoustic transducer means for converting said acoustic data signals to serial data multiplexed electrical signals; and said first multiplexing means connected to receive said serial data multiplexed electrical signals from said first acoustic transducer means and for demultiplexing said serial data multiplexed electrical signals and converting them to parallel data multiplexed signals and adapted to provide said parallel data multiplexed signals to said fire control system.

2. An acoustic prelaunch weapon communication system for providing information between a fire control system and a launchable underwater weapon electronic system comprising:

first multiplexing means adapted to receive parallel data electrical signals from said fire control system for converting said parallel data electrical signals to serial data multiplexed electrical signals, said first multiplexing means further comprises at least first and second parallel electrical lines connected to said fire control system and at least first and second multiplexer/demultiplexer units connected to respective members of said first and second parallel electrical lines;

a launch tube;

first acoustic transducer means mounted on a wall of said launch tube and connected to receive said serial data multiplexed electrical signals for converting said serial data electrical signals to acoustic data signals and transmitting said acoustic data signals, said first acoustic transducer means further comprises at least a first and second serial electrical line connected to respective members of said first and second multiplexer/demultiplexer units and at least a first and second acoustic transducer connected to respective members of said first and second serial electrical lines;

a launchable underwater weapon;

a cavity adapted to contain seawater located between and separating said launch tube and said launchable underwater weapon;

second acoustic transducer means mounted to the shell of said launchable underwater weapon and connected to receive said acoustic data signals from said first acoustic transducer means for converting said acoustic data signals to serial data multiplexed electrical signals, said second acoustic transducer means further comprises at least a third and fourth acoustic transducer and at least a third and fourth serial electrical line connected to respective members of said third and fourth acoustic transducers;

second multiplexing means located within the shell of said launchable underwater weapon and connected to receive said serial data multiplexed electrical signals and for demultiplexing said serial data multiplexed electrical signals and converting them to parallel data signals and adapted to provide said parallel data signals to said launchable underwater weapon electronic system, said second multiplexing means further comprises at least a third and fourth multiplexer/demultiplexer unit connected to respective members of said third and fourth serial electrical lines and third and fourth parallel electrical lines connected between respective members of said third and fourth multiplexer/demultiplexer units and said launchable underwater weapon electronic system, said second multiplexing means further adapted to receive parallel data electrical signals from said launchable underwater weapon electronic system for converting said parallel data electrical signals to serial data multiplexed electrical signals;

said second acoustic transducer means connected to receive said serial data multiplexed electrical signals from said second multiplexing means for converting said serial data electrical signals to acoustic data signals and transmitting said acoustic data signals;

said first acoustic transducer means connected to receive said acoustic data signals from said second acoustic transducer means for converting said acoustic data signals to serial data multiplexed electrical signals; and said first multiplexing means connected to receive said serial data multiplexed electrical signals from said first acoustic transducer means and for demultiplexing said serial data multiplexed electrical signals and converting them to parallel data multiplexed signals and adapted to provide said parallel data multiplexed signals to said fire control system.

* * * * *